US006718852B1

(12) United States Patent
Bickel et al.

(10) Patent No.: US 6,718,852 B1
(45) Date of Patent: Apr. 13, 2004

(54) GARBAGE DISPOSAL PLUNGER AND LIQUID CONTAINER APPARATUS

(75) Inventors: Harry Mordt Bickel, 3832 Beech St., Cincinnati, OH (US) 45227; Eugene L. Timperman, Cincinnati, OH (US) 45240

(73) Assignee: Harry Mordt Bickel, Cincinnati, OH (US)

( * ) Notice: Subject to any disclaimer, the term of this patent is extended or adjusted under 35 U.S.C. 154(b) by 106 days.

(21) Appl. No.: 10/037,038

(22) Filed: Oct. 29, 2001

Related U.S. Application Data

(60) Provisional application No. 60/250,544, filed on Dec. 1, 2000.

(51) Int. Cl.[7] ..... B25G 1/01
(52) U.S. Cl. ..... 81/488; 81/489; D32/35
(58) Field of Search ..... 81/488, 489; D32/35

(56) References Cited

U.S. PATENT DOCUMENTS

| | | | | |
|---|---|---|---|---|
| 3,427,636 A | | 2/1969 | Seifert | 15/105 |
| 3,765,275 A | | 10/1973 | Johnson | 81/1 R |
| 3,895,548 A | | 7/1975 | Sauve | 81/1 R |
| D239,154 S | | 3/1976 | Liddle | D7/161 |
| 4,137,538 A | * | 1/1979 | Klein | 347/164 |
| 4,137,578 A | * | 2/1979 | Felici | 4/654 |
| 4,268,080 A | | 5/1981 | Lindley | 294/1 S |
| 4,745,642 A | * | 5/1988 | Shands | 4/661 |
| 5,617,605 A | * | 4/1997 | Hoerner et al. | 15/105 |
| D398,104 S | | 9/1998 | Raines | D32/35 |
| 6,192,525 B1 | * | 2/2001 | Tash | 4/255.11 |

* cited by examiner

*Primary Examiner*—Joseph J. Hail, III
*Assistant Examiner*—Alvin J. Grant
(74) *Attorney, Agent, or Firm*—Frederick H. Gribbell

(57) ABSTRACT

A garbage disposal plunger is provided that is designed to push refuse into a standard kitchen sink garbage disposal unit. The plunger apparatus includes four major sections: a knob portion, handle portion, stopper portion, and plunger portion. The knob portion is used to prevent the human hand of the user from slipping while gripping the device; the handle portion acts as a shank between the gripable knob and the plunger and, in conjunction with the knob portion, is designed to aid the human user of the device for maximum gripping capabilities and comfort. The stopper portion manifests a larger diameter which prevents the plunger portion of the device from contacting the blades of the garbage disposal, and prevents the human hand of the user from entering the garbage disposal. The plunger apparatus contains a liquid which can be dispensed through a spout which has a lid.

24 Claims, 17 Drawing Sheets

GARBAGE DISPOSAL PLUNGER AND LIQUID CONTAINER APPARATUS

CROSS-REFERENCE TO RELATED APPLICATIONS

This application is based in part upon a U.S. Provisional Patent Application, Serial No. 60/250,544, filed Dec. 1, 2000.

TECHNICAL FIELD

The present invention relates generally to kitchen utensils, and is particularly directed to a kitchen utensil of the type which both contains liquid (such as soap) and pushes refuse into a kitchen sink garbage disposal. The invention is specifically disclosed as a garbage disposal "plunger" that is placed into the opening of a garbage disposal up to a predetermined distance, but is prevented from being inserted past that predetermined distance by a stopper member, and which exhibits a removable lid to dispense a liquid contained therewithin.

BACKGROUND OF THE INVENTION

Kitchen utensils, used to push refuse into a kitchen sink garbage disposal, are fairly well known in the art as disclosed by way of example in U.S. Pat. No. 3,427,636 to Seifert, U.S. Pat. No. 3,765,275 to Johnson, U.S. Pat. No. 4,268,080 to Lindley, and U.S. Pat. No. 4,745,642 to Shands. For instance, the Shands device merely provides a spherical knob for the user to grip while using the device, which does not, however, allow a user's hand to be in a position to employ a substantial gripping posture. Similarly, the Seifert device provides a handle only for the user to hold, and does not provide a knob portion to prevent the user's hand from slipping off the device. The Lindley device does not include a structure which specifically prevents the fingers of the user from entering the garbage disposal.

The conventional devices that push refuse into a kitchen sink garbage disposal could easily be improved to eliminate some of their disadvantages. It would, therefore, be advantageous to provide a garbage disposal plunger that manifests improved gripping characteristics and is convenient and safe to use around working garbage disposals.

SUMMARY OF THE INVENTION

Accordingly, it is an advantage of the present invention to provide a garbage disposal waste removing apparatus having a handle portion in conjunction with a knob portion which allows the user to employ a tactile posture that provides better gripping capabilities for convenience of use and added safety.

It is another advantage of the present invention to provide a garbage disposal waste removing apparatus having a stopper portion that is large enough to prevent a user's hand from entering a sink garbage disposal unit to add a further safety feature to a handle portion and a knob portion which allow the user to employ a tactile posture that provides better gripping capabilities.

It is a further advantage of the present invention to provide a garbage disposal waste removing apparatus having a handle portion in conjunction with a knob portion which allows the user to employ a tactile posture that provides better gripping capabilities for convenience of use and added safety, and further includes a plunger portion with a cylindrical shape exhibiting a substantially constant diameter that is long enough to push refuse into the sink garbage disposal, yet is mated to a stopper portion that limits the effective length of the plunger portion so as to not contact the blades of the garbage disposal unit.

It is yet a further advantage of the present invention to provide a garbage disposal waste removing apparatus having a handle portion in conjunction with a knob portion which allows the user to employ a tactile posture that provides better gripping capabilities for convenience of use and added safety, and in which the knob portion also contains a lid that provides access to an interior chamber containing a liquid, which thereby allows the user to dispense the liquid (e.g., a dishwasher detergent) from the interior chamber.

It is still another advantage of the present invention to provide a garbage disposal waste removing apparatus having a stopper portion that is large enough to prevent a user's hand from entering a sink garbage disposal unit to add a further safety feature to a handle portion and a knob portion which allow the user to employ a tactile posture that provides better gripping capabilities, and in which the knob portion also contains a lid that provides access to an interior chamber containing a liquid, which thereby allows the user to dispense the liquid (e.g., a dishwasher detergent) from the interior chamber.

It is still a further advantage of the present invention to provide a garbage disposal waste removing apparatus having a handle portion in conjunction with a knob portion that also contains a lid that provides access to an interior chamber containing a liquid, which thereby allows the user to dispense the liquid (e.g., a dishwasher detergent) from the interior chamber, and further includes a plunger portion with a cylindrical shape exhibiting a substantially constant diameter that is long enough to push refuse into the sink garbage disposal, yet is mated to a stopper portion that limits the effective length of the plunger portion so as to not contact the blades of the garbage disposal unit.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, an improved garbage disposal plunger device is provided that, in a preferred embodiment, is constructed of molded plastic so as to be lightweight yet of sturdy construction. The plunger device is designed to push refuse into a standard kitchen sink garbage disposal unit that grinds waste and sends it down the drain pipe. The device includes four major sections: a knob portion or member, a handle portion or member, a stopper portion or member, and a plunger portion or member.

The knob portion/member has an overall rounded appearance and is used to prevent the human hand of a human user from slipping while gripping the plunger device. The handle portion/member acts as a shank between the gripable knob and the plunger, and has an outline that exhibits a mildly curved convex shape. The gradually shaped convex surface of the handle, in conjunction with the knob portion, is designed to enhance the gripping capabilities of the human user while also providing a surface shape that aids comfort when gripped by the user's hand.

The knob portion exhibits an outer contour shape that exhibits a maximum cross-section near the end of the plunger apparatus that is proximal to the human user (and distal from the garbage disposal unit), yet smoothly changes to a minimum cross-section at the very proximal end portion of the plunger apparatus. In addition, the knob's maximum cross-section smoothly changes to a smaller cross-section at a location where it meets said handle member in their adjacent relationship. This smaller cross-section of the knob as it meets the handle portion provides a contoured surface area that is easily gripped by the fingers of a human hand. Moreover, the maximum cross-section in combination with the smoothly changing minimum cross-section at the very end of the knob provide a different contoured surface area that mates well to the palm of a human hand. This shape enhances the "gripability" of the plunger apparatus by the user's hand.

The stopper portion/member is located approximately at the mid-portion of the plunger device. The stopper portion manifests a larger diameter as compared to both the handle portion and the plunger portion, and is used as a "stopper" to prevent the plunger portion of the device from contacting the blades of the garbage disposal. Also, the stopper portion prevents the human hand of the user from entering the garbage disposal.

The plunger portion/member is used to push the refuse into the garbage disposal unit. The plunger portion is mainly cylindrical in shape, having a substantially constant diameter. In the preferred embodiment, the main diameter of the plunger portion is sized to fit into the standard kitchen garbage disposal unit opening, with a small amount of clearance for an easy insertion fit.

In an alternative preferred embodiment, the garbage disposal plunger device has a lid at its top portion (i.e., at the handle's knob) that can be removed to allow access to an interior volume which contains a liquid. This interior volume can run essentially throughout the entire inner surfaces that make up the molded walls of the device, and the liquid contained therewithin could be a dishwasher detergent, for example, or some other liquid that is useful in the kitchen. Other useful liquids could include hand soap or a sink cleanser, for example. The lid could be a snap-on/snap-off cap that is hinged, or that literally snaps completely off, or it could be a threaded design that twists on and off, which is the embodiment illustrated below.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
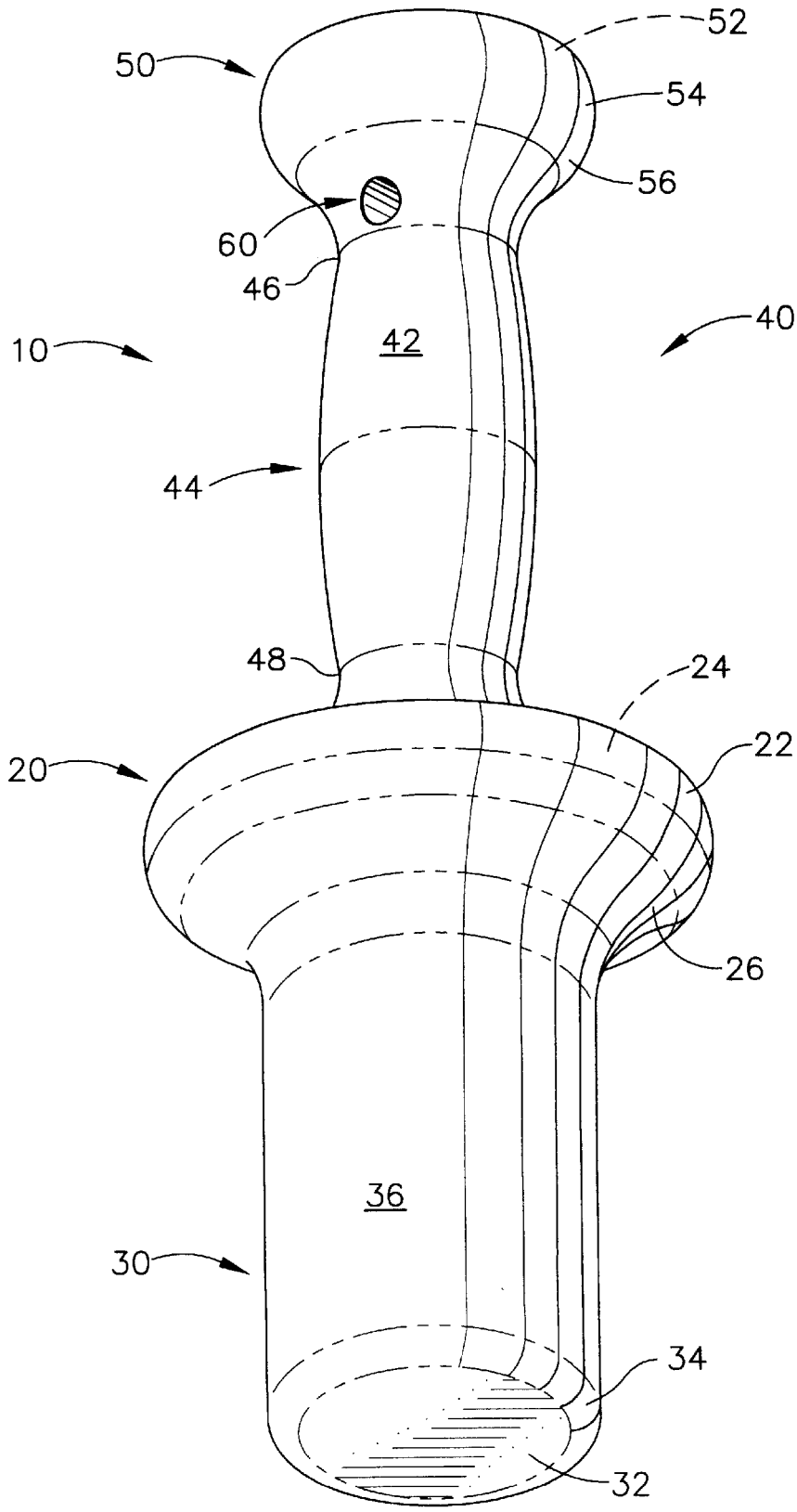
FIG. 1 is a perspective view from the front and the side of a garbage disposal plunger built according to the principles of the present invention.

Referring now to the drawings, FIG. 1 shows a garbage disposal plunger device generally designated by the reference numeral 10 that is constructed in accordance with the principles of the present invention. The device could be made of any durable material including plastics, metal or wood. In a preferred embodiment, the device 10 would be made of molded plastic, but any suitable material could be used without departing from the principles of the present invention. The plunger device 10 includes four major sections: a handle portion 40, a knob portion 50, a stopper portion 20 and a plunger portion 30.

The handle portion 40 preferably exhibits a contoured surface having a gradual convex shape, as seen at 42, with a maximum outer diameter 44 at a distance that is approximately halfway between a top minimum outer diameter at 46 and a bottom minimum outer diameter at 48. This configuration gives the handle portion 40 an overall curved shape. The gradually shaped convex surface 42 is designed to aid a human user of the device 10 for maximum gripping capabilities and comfort.

The handle portion 40 also includes a through hole 60 located in an area near the boundary between the handle portion 40 and the knob portion 50. A string (not shown in FIG. 1) can be inserted through the through hole 60 to enable the device 10 to be hung on a hook in a household pantry or any other convenient location as desired by the human user.

Such a through hole 60 could be located at other locations of the device 10 without departing from the principles of the present invention, or optionally the through hole could be omitted entirely.

The knob portion 50 tends to prevent the human hand from slipping while gripping the handle portion 40. The knob portion 50 preferably exhibits a rounded contour surface at 56, having a maximum outer diameter seen at 54. This configuration also gives the knob portion 50 an overall rounded appearance.

The plunger portion 30 preferably exhibits a cylindrical surface 36 of substantially constant diameter, having a planar surface 32, at the distal end of the device 10. A rounded edge at 34 changes the diameter between the planar surface 32 at the distal end of the device 10 and the cylindrical surface 36 of the plunger portion 30. It will be understood that the overall outer dimensions of plunger portion 30 are not constrained to be an exact cylinder with a perfectly straight contour, but instead could exhibit a mildly curved or tapered shape without departing from the principles of the present invention.

The stopper portion 20 is used to protect the hand of the human user from accidentally entering the garbage disposal, and to prevent the distal end surface at 32 from contacting the moving blades of a garbage disposal in use while the device 10 is being placed into the bottom area of a sink. The stopper portion exhibits a maximum outer diameter at 22 which is also the maximum outer diameter of the entire device 10. FIG. 1 shows a portion at 26 along the bottom area of the stopper portion 20, which exhibits a change in diameter 26 between the maximum diameter at 22 of the stopper portion 20 and the cylindrical surface 36 of the plunger portion 30. A substantially symmetrical change in diameter is also exhibited along the top area at 24 of the stopper portion 20, which is not shown in FIG. 1. Thus the stopper portion exhibits rounded, substantially smoothly outer edges due to its outer contoured shape at 22, 24, and 26 (see FIG. 3).

Figure 2:
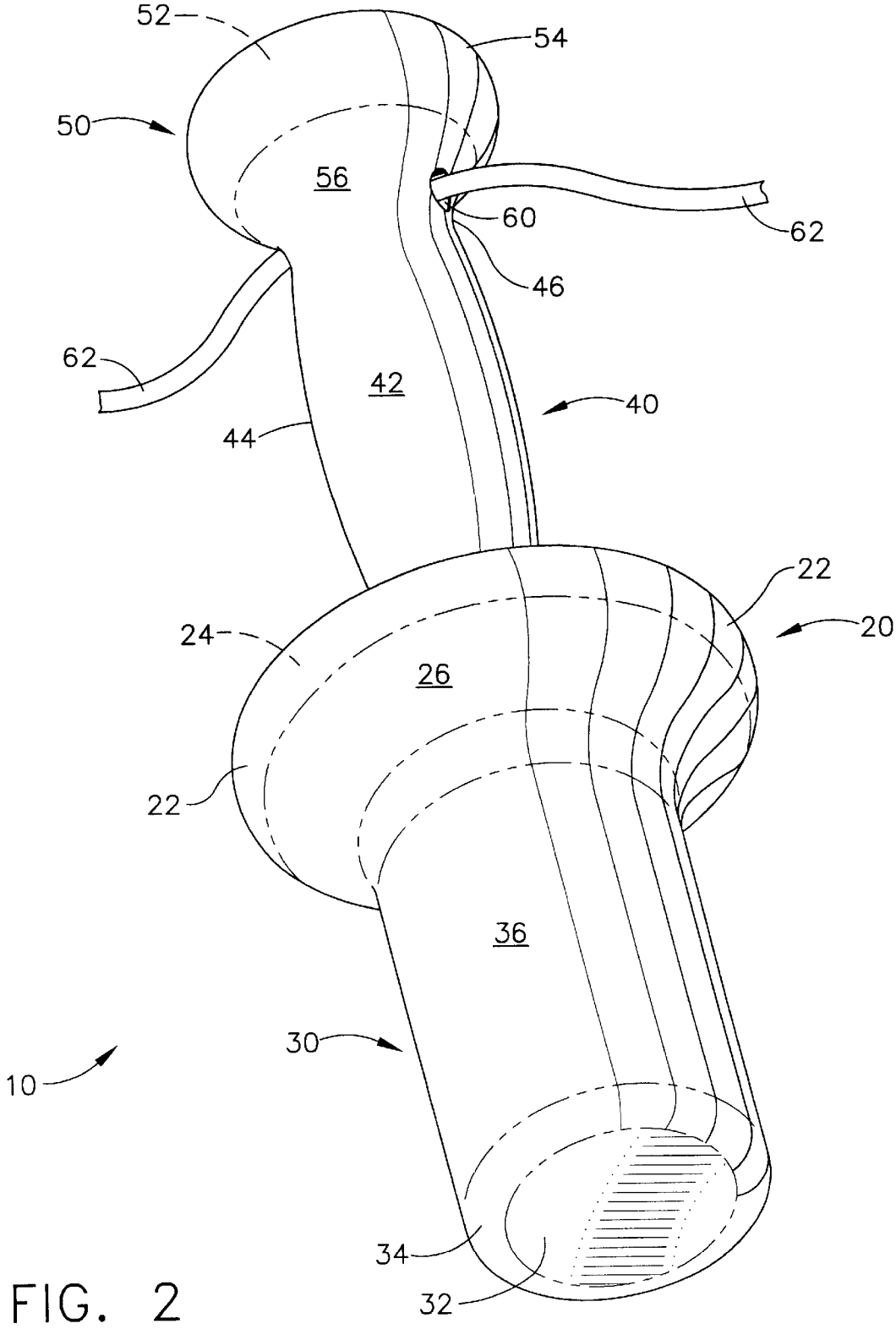
FIG. 2 is a perspective view of the garbage disposal plunger of FIG. 1 showing the apparatus from a view that is further along its side.

FIG. 2 shows a second perspective view from further along the side of the plunger device 10. FIG. 2 shows a string 62 or similar flexible object which is placed through the hole 60. String 62 is used for hanging the device 10, as noted above. As can be seen in this view, the plunger device 10 is substantially of the same shape as viewed in FIG. 1.

Figure 3:
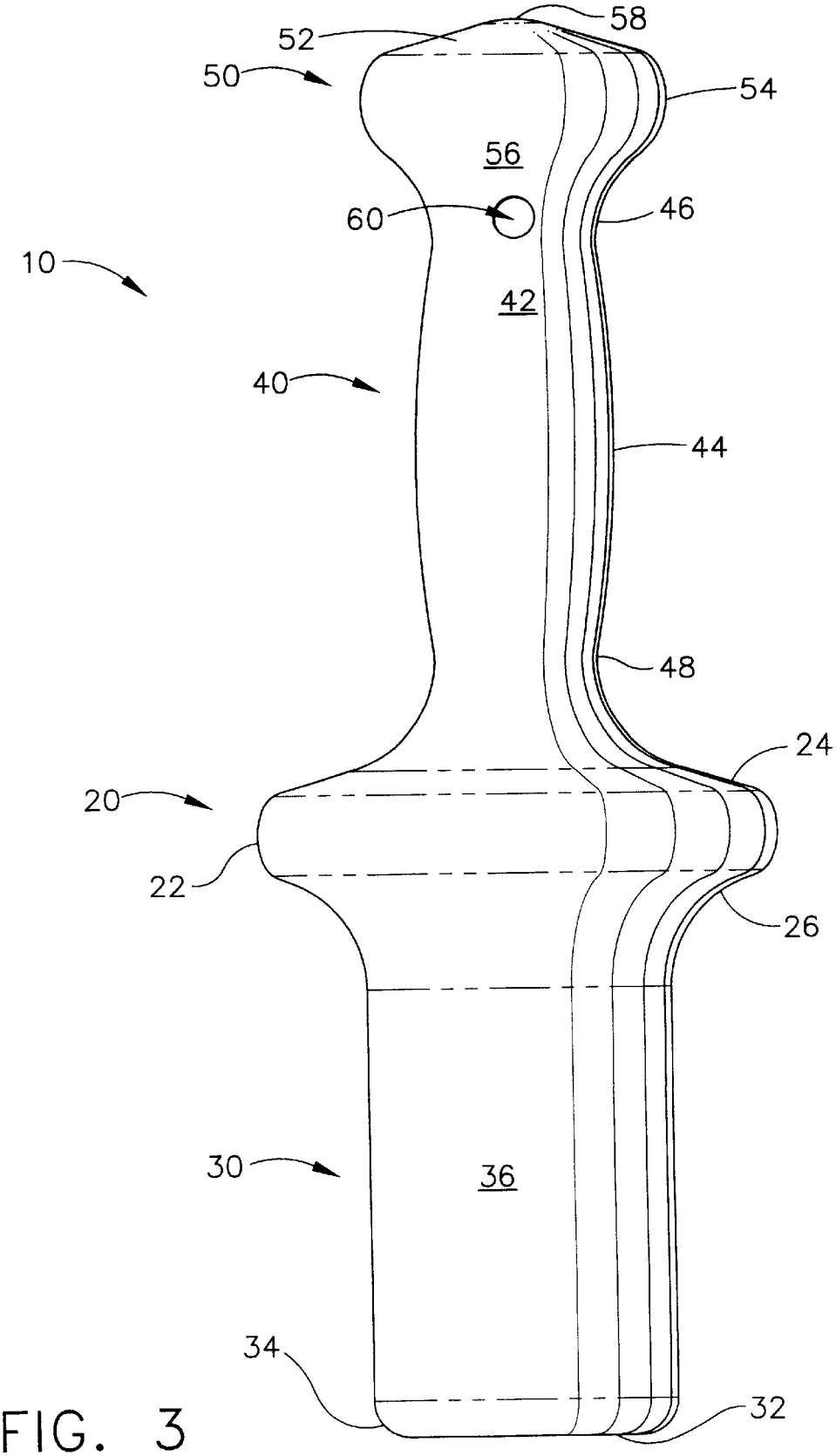
FIG. 3 is a front elevational view of the garbage disposal plunger of FIG. 1.

FIG. 3 shows a front elevational view of the plunger device 10. In FIG. 3, the proximal end surface at 52 of the device 10 can be viewed, as well as the most proximal point or peak of the knob at 58. Additionally, the rounded top surface 24 of the stopper portion 20 can be seen in this view. FIG. 3 more clearly shows the planar shape of the distal surface 32 of the device 10, and the rounded change in diameter at 34 of the plunger portion 30.

The knob portion 50 exhibits an outer contour shape that exhibits a maximum cross-section at 54 near the end of the plunger apparatus, and smoothly changes to a minimum cross-section at 58 that form the very proximal end portion of the plunger apparatus (at the point or peak 58). This smoothly changing cross-sectional area is due to the rapidly decreasing diameter of the knob portion, as viewed at 52, between the peak 58 and the maximum diameter at 54.

In addition, the knob's maximum cross-section at 54 smoothly changes to a smaller cross-section at a location where it meets said handle member (i.e., at 46) in their adjacent relationship. This smaller cross-section of the knob at 46 as it meets the handle portion provides a contoured surface area at 56 that is easily gripped by the fingers of a human hand. Moreover, the maximum cross-section at 54 in combination with the smoothly changing minimum cross-section at the very end of the knob (i.e., and the peak 58) provide a different contoured surface area that mates well to the palm of a human hand. This shape enhances the "gripability" of the plunger apparatus by the user's hand.

Figure 4:
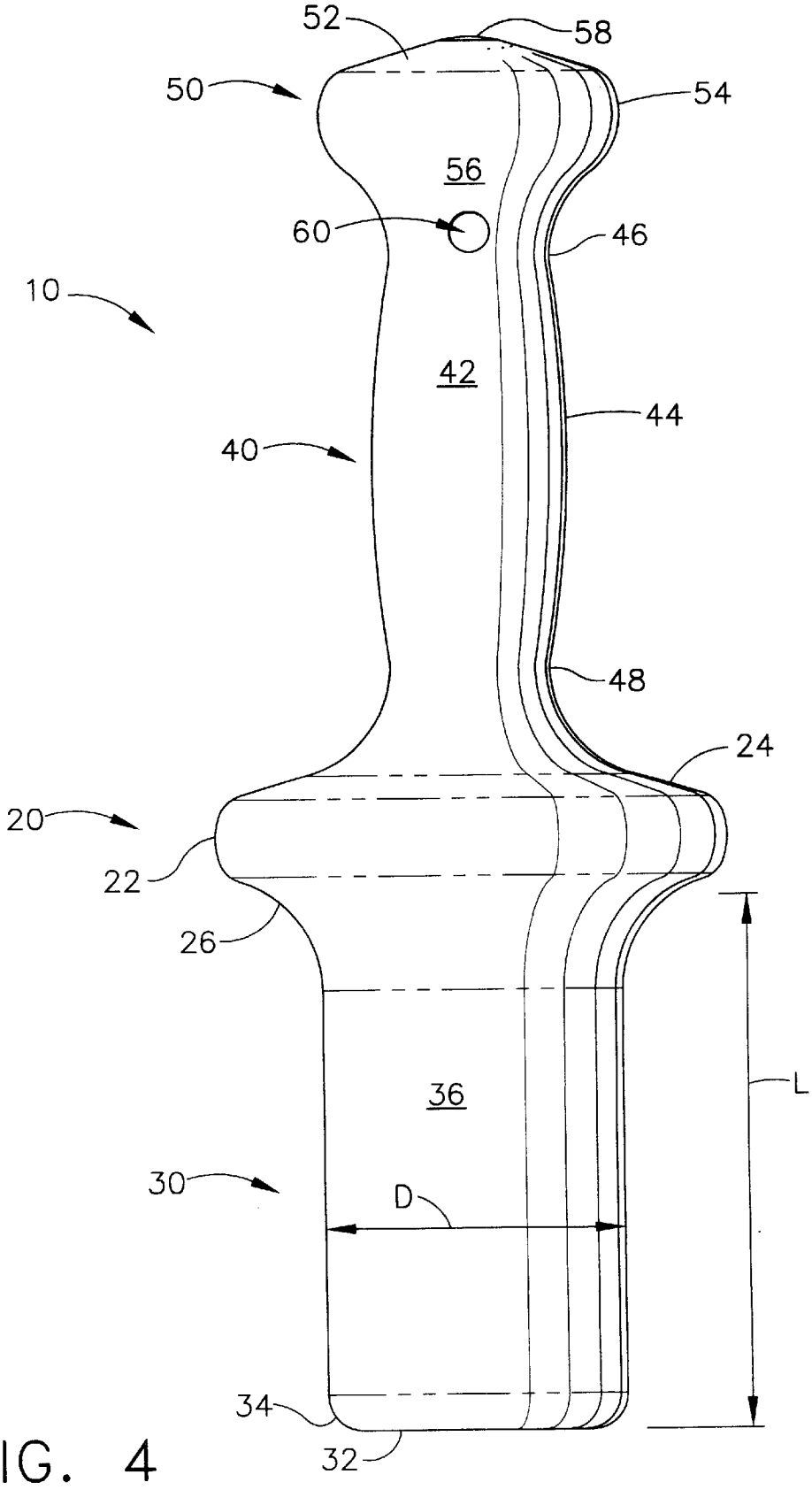
FIG. 4 is a rear elevational view of the garbage disposal plunger of FIG. 1.

FIG. 4 shows a rear elevational view of the plunger device 10. FIG. 4 indicates a constant diameter "D" of the plunger portion 30. In the preferred embodiment, the diameter D is sized to easily fit into a standard kitchen sink drain hole. Additionally, the plunger portion 30 has a length, "L", which in the preferred embodiment is short enough not to touch the blades of the garbage disposal yet long enough to effectively push all the garbage into the disposal.

Figure 5:
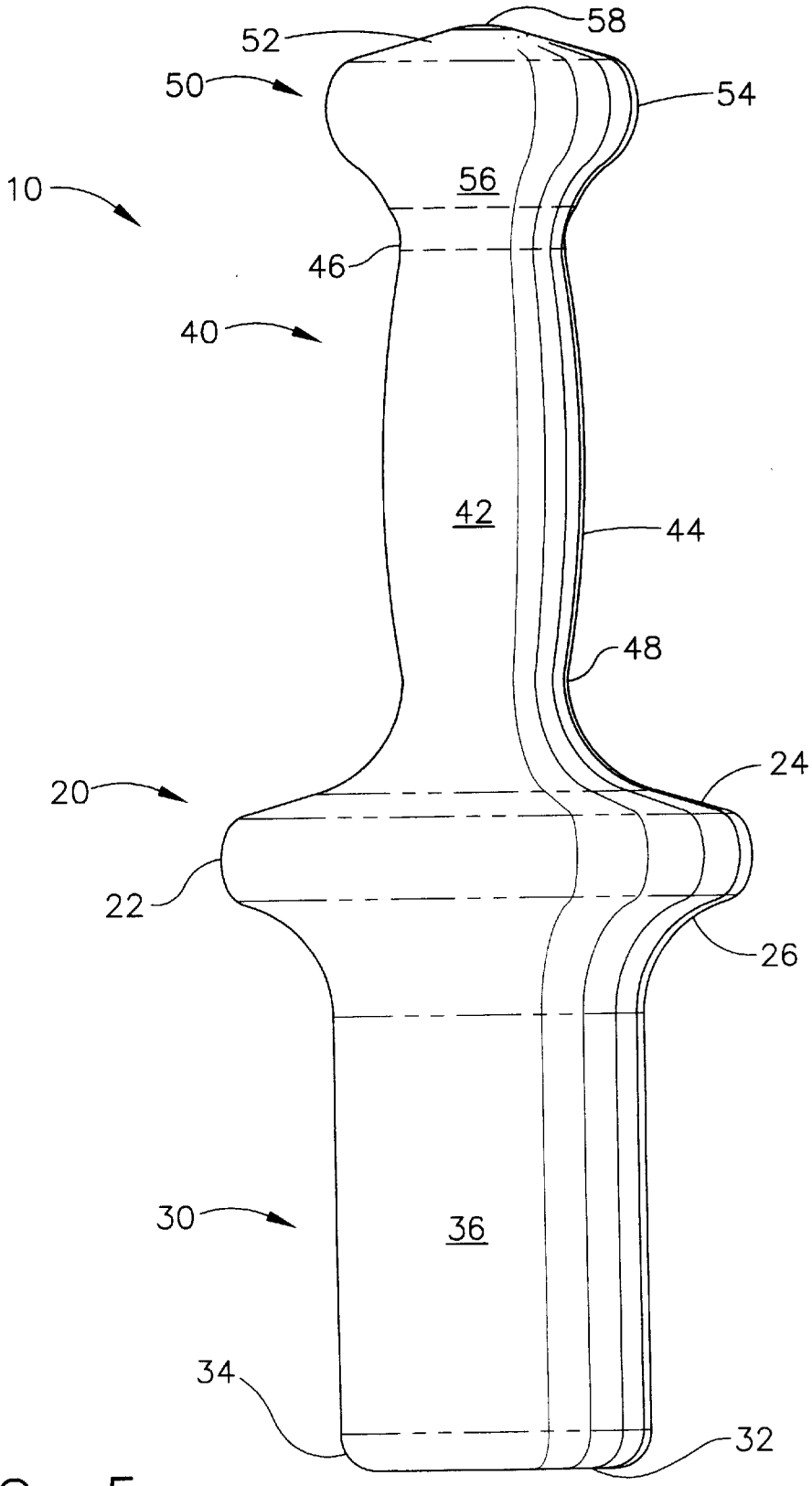
FIG. 5 is a side elevational view of the garbage disposal plunger of FIG. 1 from its right side (as viewed in FIG. 1).
Figure 6:
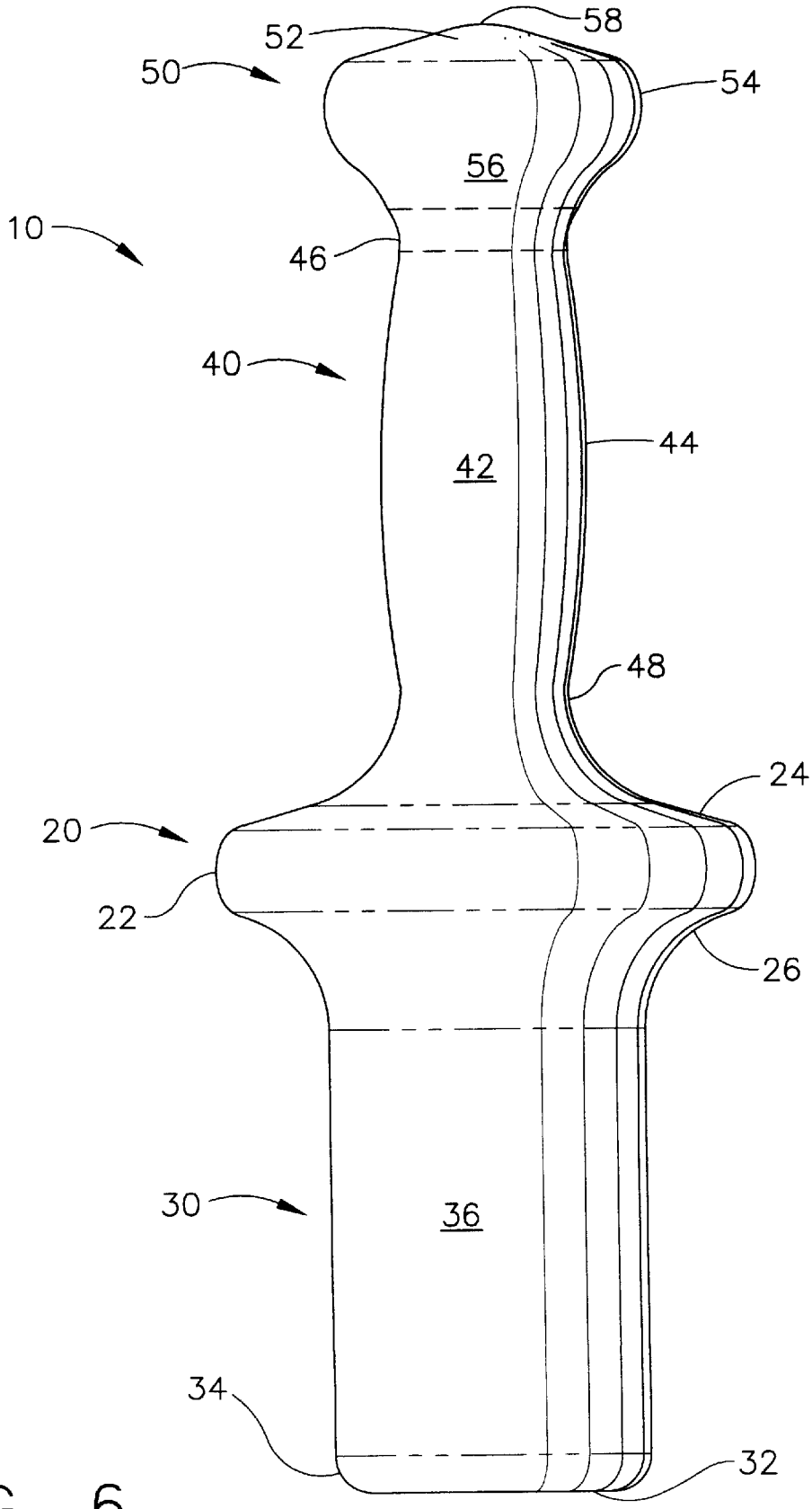
FIG. 6 is a side elevational view of the garbage disposal plunger of FIG. 1 from its left side (as viewed in FIG. 1).

FIG. 5 and FIG. 6 are a right side elevational view and a left side elevational view of the plunger device 10, respectively. FIGS. 5 and 6 show the same general features as seen in FIG. 4.

Figure 7:
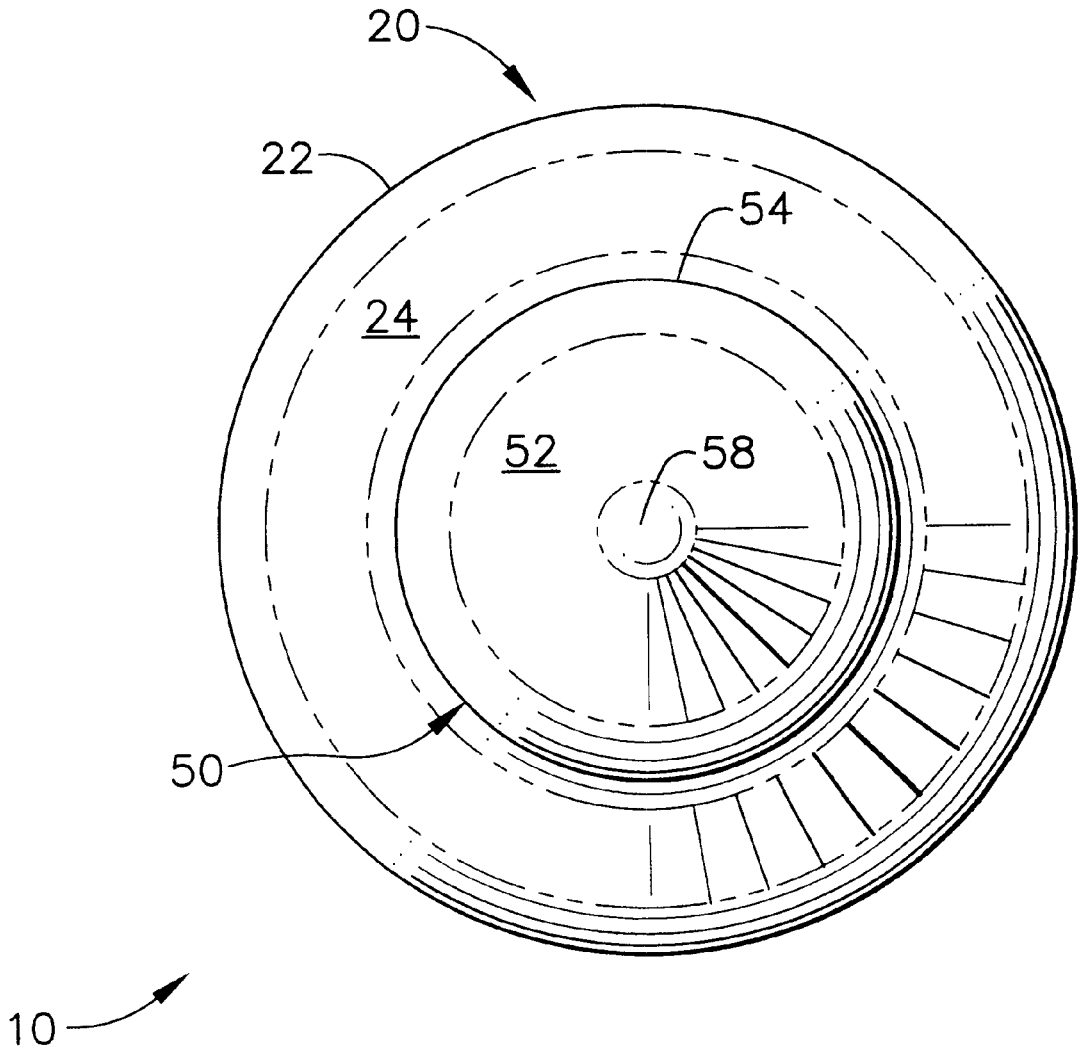
FIG. 7 is a top plan view of the garbage disposal plunger of FIG. 1.

FIG. 7 is a top planar view of the plunger device IC. FIG. 7 shows the rounded outer shape of the stopper portion 20 with its maximum outer diameter at 22, the knob portion 50 with its maximum outer diameter 54, and a peak or most proximal point 58 in the knob portion 50.

Figure 8:
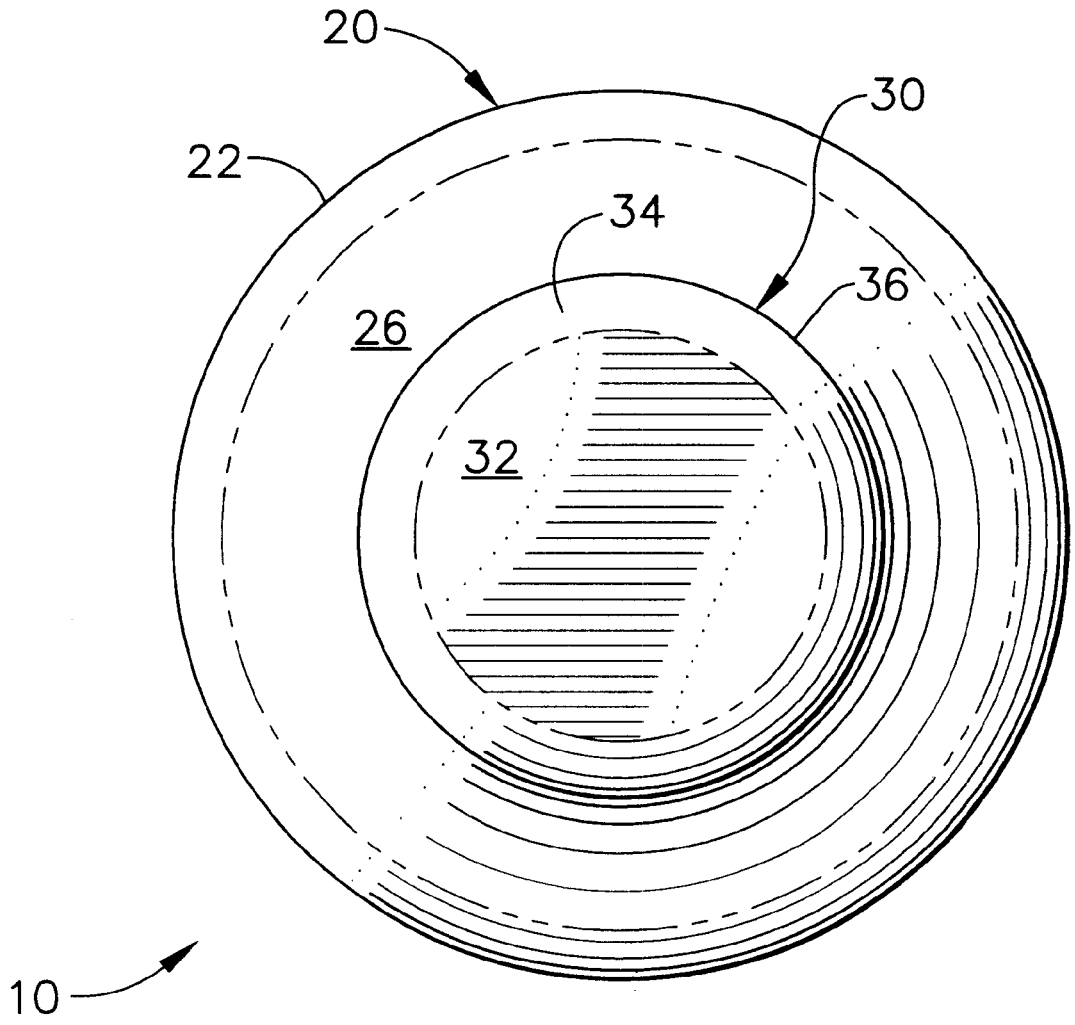
FIG. 8 is a bottom plan view of the garbage disposal plunger of FIG. 1.

FIG. 8 is a bottom planar view of the plunger device 10. FIG. 8 shows the rounded outer shape of the stopper portion 20 with its maximum outer diameter 22. FIG. 8 also shows the rounded outer shape of the cylindrical plunger portion 30 having a distal end surface 32 which is preferably planar, and which has its circular outer diameter (in this view) at 36.

Figure 9:
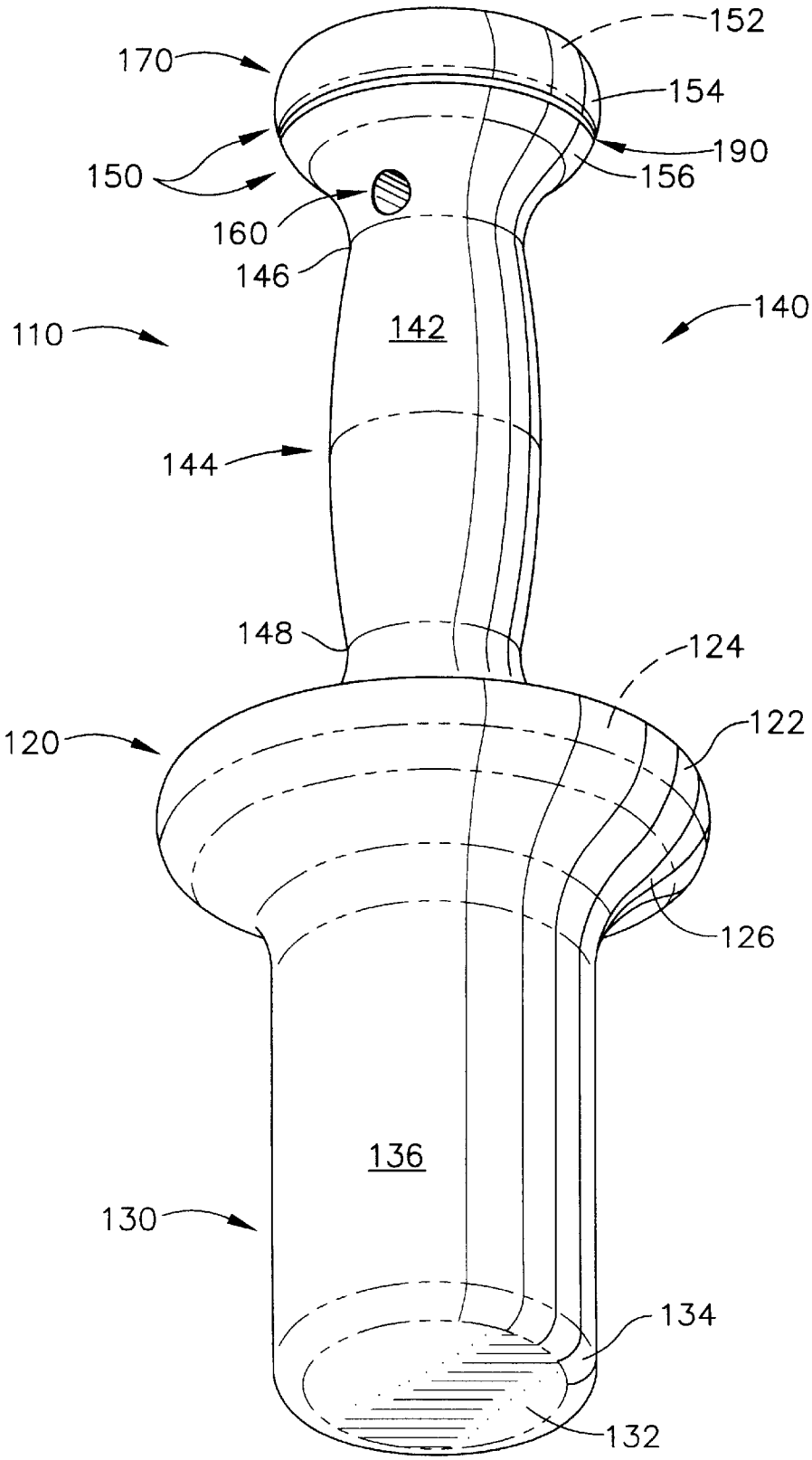
FIG. 9 is a perspective view from the front and the side of a second preferred embodiment of a garbage disposal plunger built according to the principles of the present invention.

Referring now to FIG. 9, an alternative embodiment of a garbage disposal plunger device is generally designated by the reference numeral 110, and is constructed in accordance with the principles of the present invention. The plunger device 110 is generally designed to be constructed of plastic, preferably using a plastic blow molding process. This plunger device 110 could be made of an alternative material, however, this alternative embodiment preferably includes an interior chamber to hold a liquid material, and is therefore essentially hollow in construction. Plunger device 110 includes four major sections: a handle portion 140, a knob portion 150, a stopper portion 120 and a plunger portion 130.

The knob portion 150 includes a removable lid 170, and a lid gap at 190 is illustrated as the separation line between the upper and lower members of the knob portion 150. The upper member of the knob portion 150 includes the surfaces 152 and 154, which are described below in greater detail. The lower member of the knob portion 150 includes the surfaces 146 and 156, which are described below in greater detail. Finally, the details of the lid 170 construction are discussed below with regard to the discussion of FIG. 17.

The handle portion 140 preferably exhibits a contoured surface having a gradual convex shape, as seen at 142, with a maximum outer diameter 144 at a distance that is approximately halfway between a top minimum outer diameter at 146 and a bottom minimum outer diameter at 148. This configuration gives the handle portion 140 an overall curved shape. The gradually shaped convex surface 142 is designed to aid a human user of the device 110 for maximum gripping capabilities and comfort.

The handle portion 140 also includes a through hole 160 located in an area near the boundary between the handle portion 140 and the knob portion 150. A string (not shown in FIG. 9) can be inserted through the through hole 160 to enable the plunger device 110 to be hung on a hook in a household pantry or any other convenient location as desired by the human user. Such a through hole 160 could be located at other locations of the device 110 without departing from the principles of the present invention, or optionally the through hole could be omitted entirely.

The knob portion 150 tends to prevent the human hand from slipping while gripping the handle portion 140. The knob portion 150 preferably exhibits a rounded contour surface at 156, having a maximum outer diameter seen at 154. This configuration also gives the knob portion 150 an overall rounded appearance.

The plunger portion 130 preferably exhibits a cylindrical surface 136 of substantially constant diameter, having a planar surface 132, at the distal end of the device 110. A rounded edge at 134 changes the diameter between the planar surface 132 at the distal end of the device 110 and the cylindrical surface 136 of the plunger portion 130. It will be understood that the overall outer dimensions of plunger portion 130 are not constrained to be an exact cylinder with a perfectly straight contour, but instead could exhibit a mildly curved or tapered shape without departing from the principles of the present invention.

The stopper portion 120 is used to protect the hand of the human user from accidentally entering the garbage disposal, and to prevent the distal end surface at 132 from contacting the moving blades of a garbage disposal in use while the device 110 is being placed into the bottom area of a sink. The stopper portion exhibits a maximum outer diameter at 122 which is also the maximum outer diameter of the entire device 110. FIG. 9 shows a portion at 126 along the bottom area of the stopper portion 120, which exhibits a change in diameter 126 between the maximum diameter at 122 of the stopper portion 120 and the cylindrical surface 136 of the plunger portion 130. A substantially symmetrical change in diameter is also exhibited along the top area at 124 of the stopper portion 120, which is not shown in FIG. 9. Thus the stopper portion exhibits rounded, substantially smoothly outer edges due to its outer contoured shape at 122, 124, and 126 (see FIG. 11).

Figure 10:
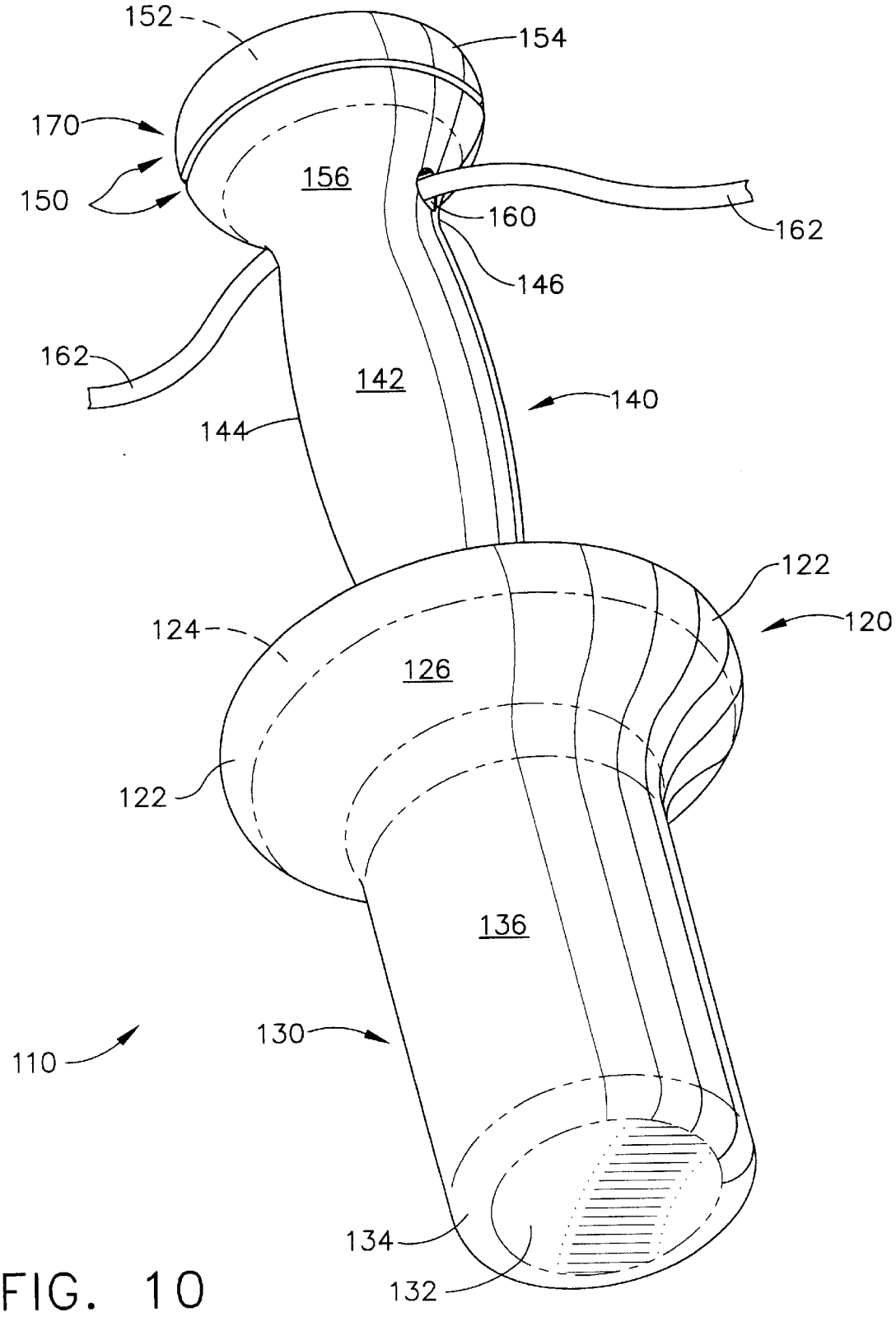
FIG. 10 is a perspective view of the garbage disposal plunger of FIG. 9 showing the apparatus from a view that is further along its side.

FIG. 10 shows a second perspective view from further along the side of the plunger device 110. FIG. 10 shows a string 162 or similar flexible object which is placed through the hole 160. String 162 is used for hanging the device 110, as noted above. As can be seen in this view, the plunger device 110 is substantially of the same shape as viewed in FIG. 9.

Figure 11:
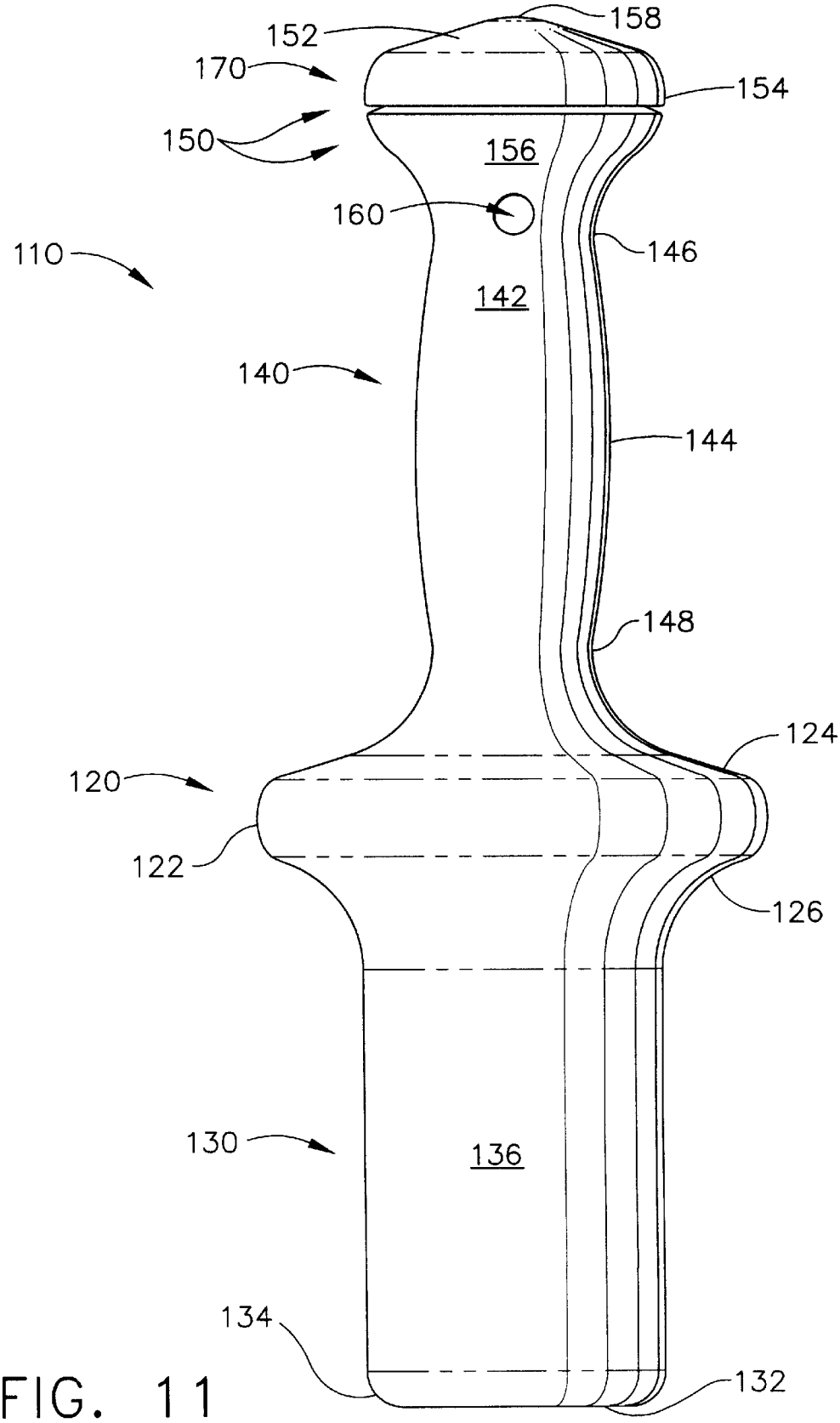
FIG. 11 is a front elevational view of the garbage disposal plunger of FIG. 9.

FIG. 11 shows a front elevational view of the plunger device 110. In FIG. 11, the proximal end surface at 152 of the device 110 can be viewed, as well as the most proximal point or peak of the knob at 158. Additionally, the rounded top surface 124 of the stopper portion 120 can be seen in this view. FIG. 11 more clearly shows the planar shape of the distal surface 132 of the device 110, and the rounded change in diameter at 134 of the plunger portion 130.

The knob portion 150 exhibits an outer contour shape that exhibits a maximum cross-section at 154 near the end of the plunger apparatus, and smoothly changes to a minimum cross-section at 158 that form the very proximal end portion of the plunger apparatus (at the point or peak 158). This smoothly changing cross-sectional area is due to the rapidly decreasing diameter of the knob portion, as viewed at 152, between the peak 158 and the maximum diameter at 154.

In addition, the knob's maximum cross-section at 154 smoothly changes to a smaller cross-section at a location where it meets said handle member (i.e., at 146) in their adjacent relationship. This smaller cross-section of the knob at 146 as it meets the handle portion provides a contoured surface area at 156 that is easily gripped by the fingers of a human hand. Moreover, the maximum cross-section at 154 in combination with the smoothly changing minimum cross-section at the very end of the knob (i.e., and the peak 158) provide a different contoured surface area that mates well to the palm of a human hand. This shape enhances the "gripability" of the plunger apparatus by the user's hand.

Figure 12:
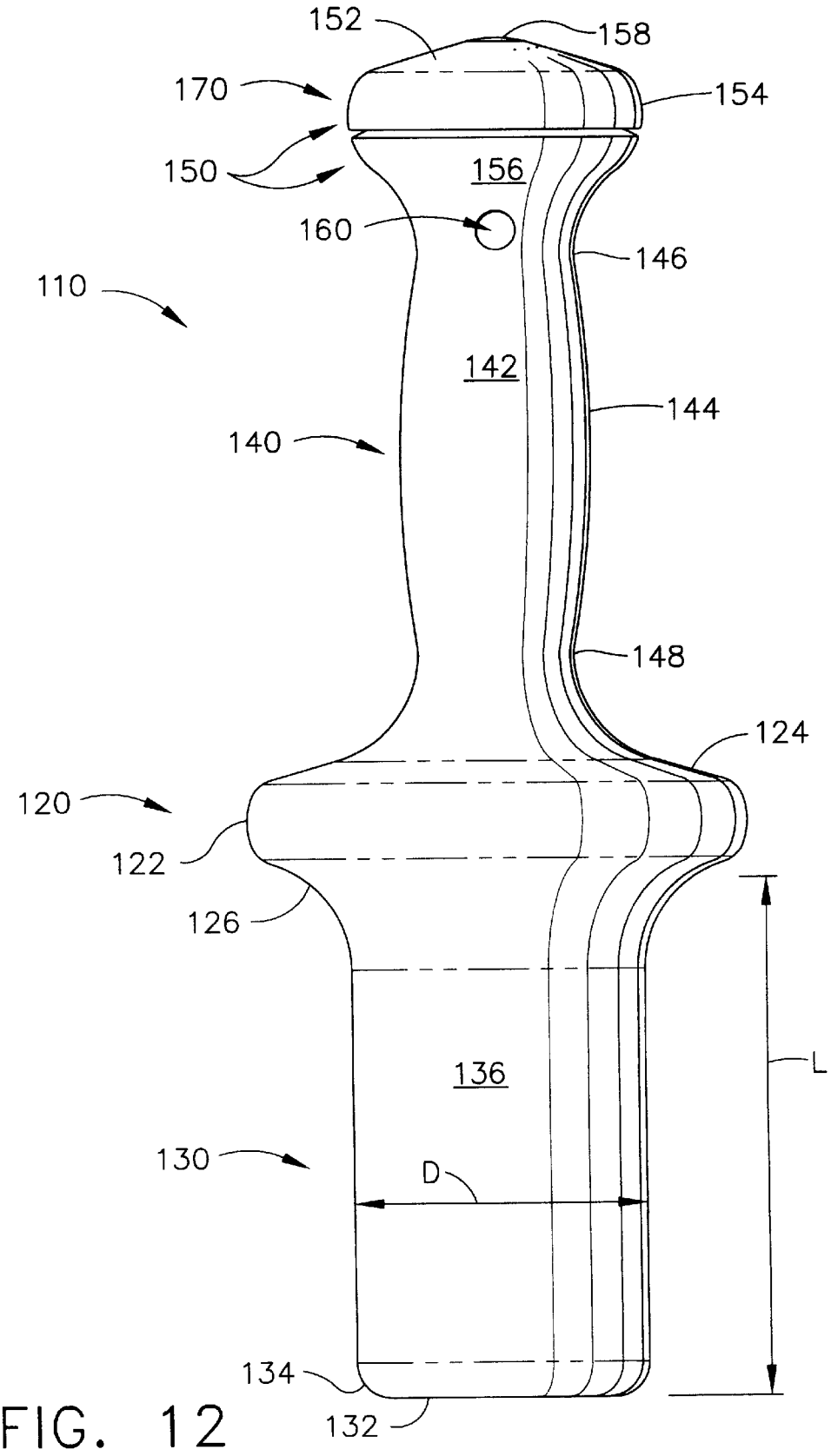
FIG. 12 is a rear elevational view of the garbage disposal plunger of FIG. 9.

FIG. 12 shows a rear elevational view of the plunger device 110. FIG. 12 indicates a constant diameter "D" of the plunger portion 130. In the preferred embodiment, the diameter D is sized to easily fit into a standard kitchen sink drain hole. Additionally, the plunger portion 130 has a length, "L", which in the preferred embodiment is short enough not to touch the blades of the garbage disposal yet long enough to effectively push all the garbage into the disposal.

Figure 13:
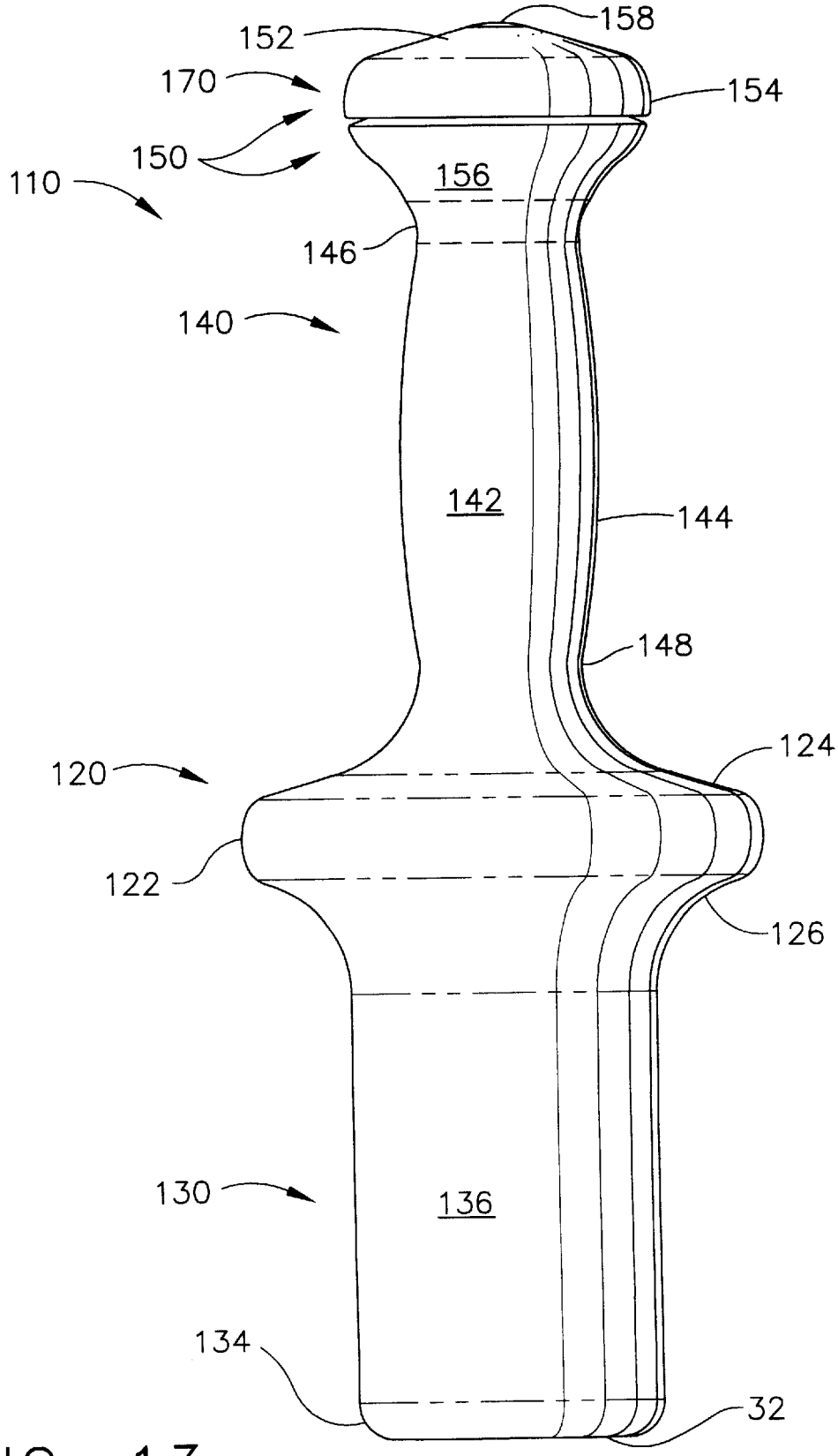
FIG. 13 is a side elevational view of the garbage disposal plunger of FIG. 9 from its right side (as viewed in FIG. 9).
Figure 14:
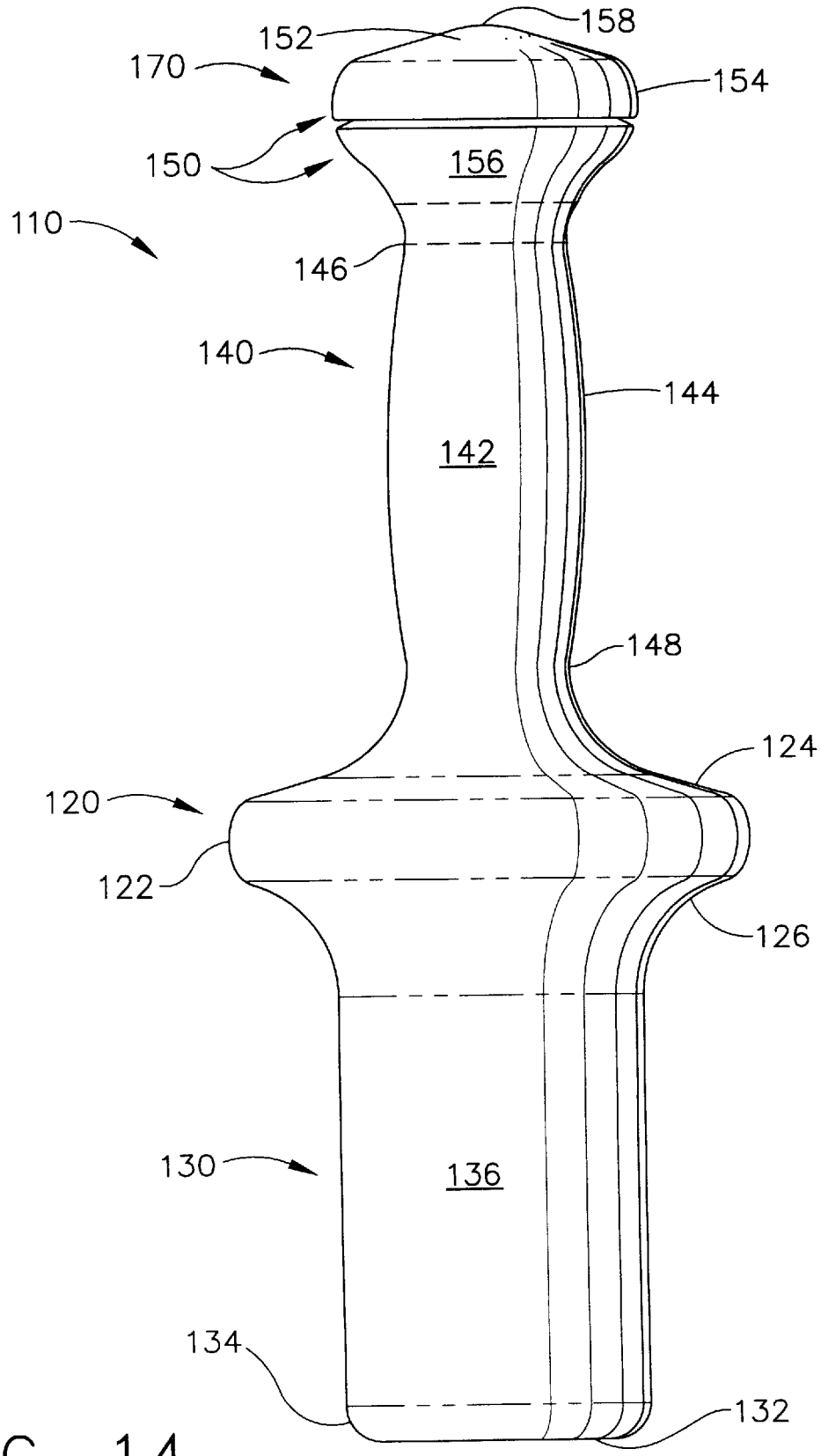
FIG. 14 is a side elevational view of the garbage disposal plunger of FIG. 9 from its left side (as viewed in FIG. 9).

FIG. 13 and FIG. 14 are a right side elevational view and a left side elevational view of the plunger device 110, respectively. FIGS. 13 and 14 show the same general features as seen in FIG. 12.

Figure 15:
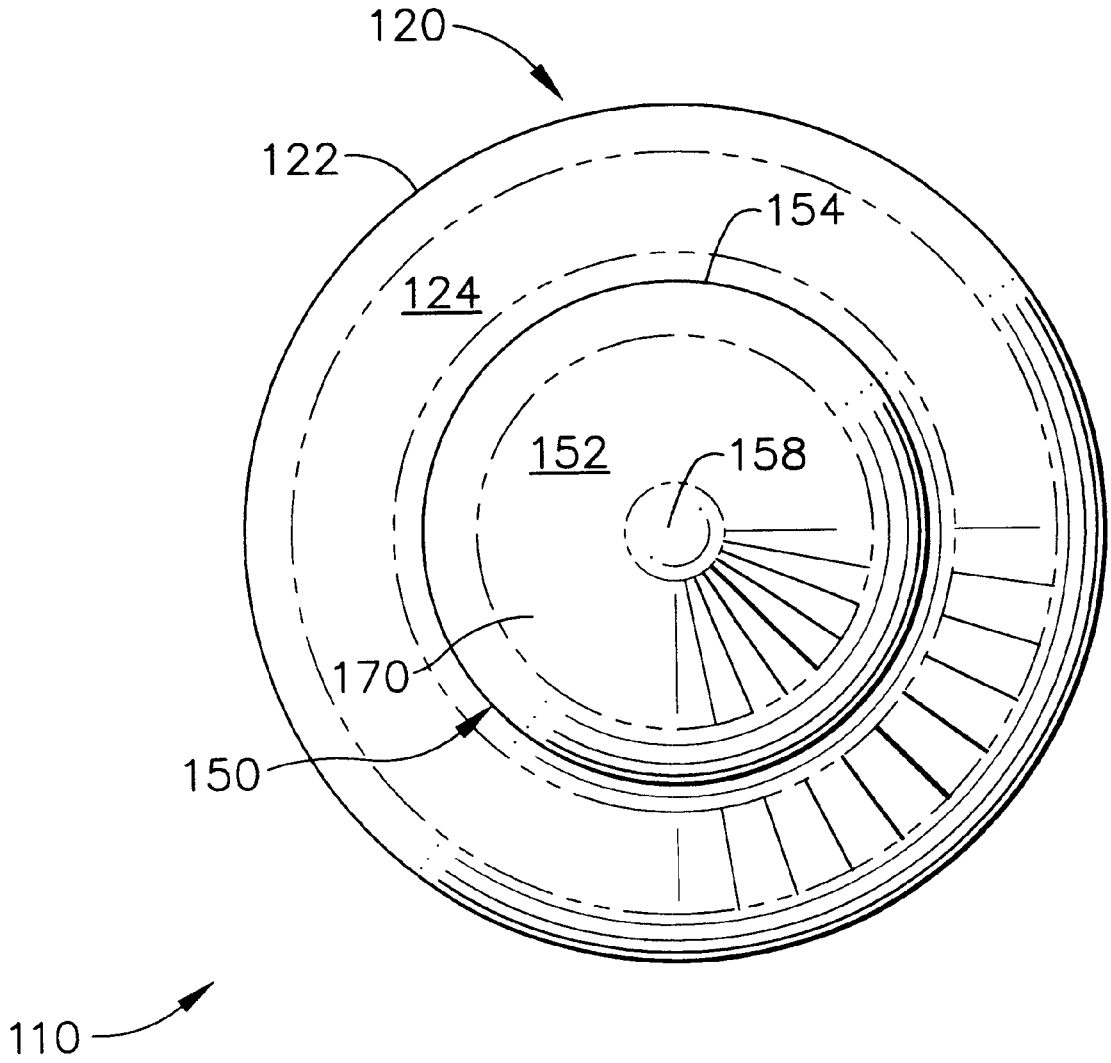
FIG. 15 is a top plan view of the garbage disposal plunger of FIG. 9.

FIG. 15 is a top planar view of the plunger device 110. FIG. 15 shows the rounded outer shape of the stopper portion 120 with its maximum outer diameter at 122, the knob portion 150 with its maximum outer diameter 154, and a peak or most proximal point 158 in the knob portion 150.

Figure 16:
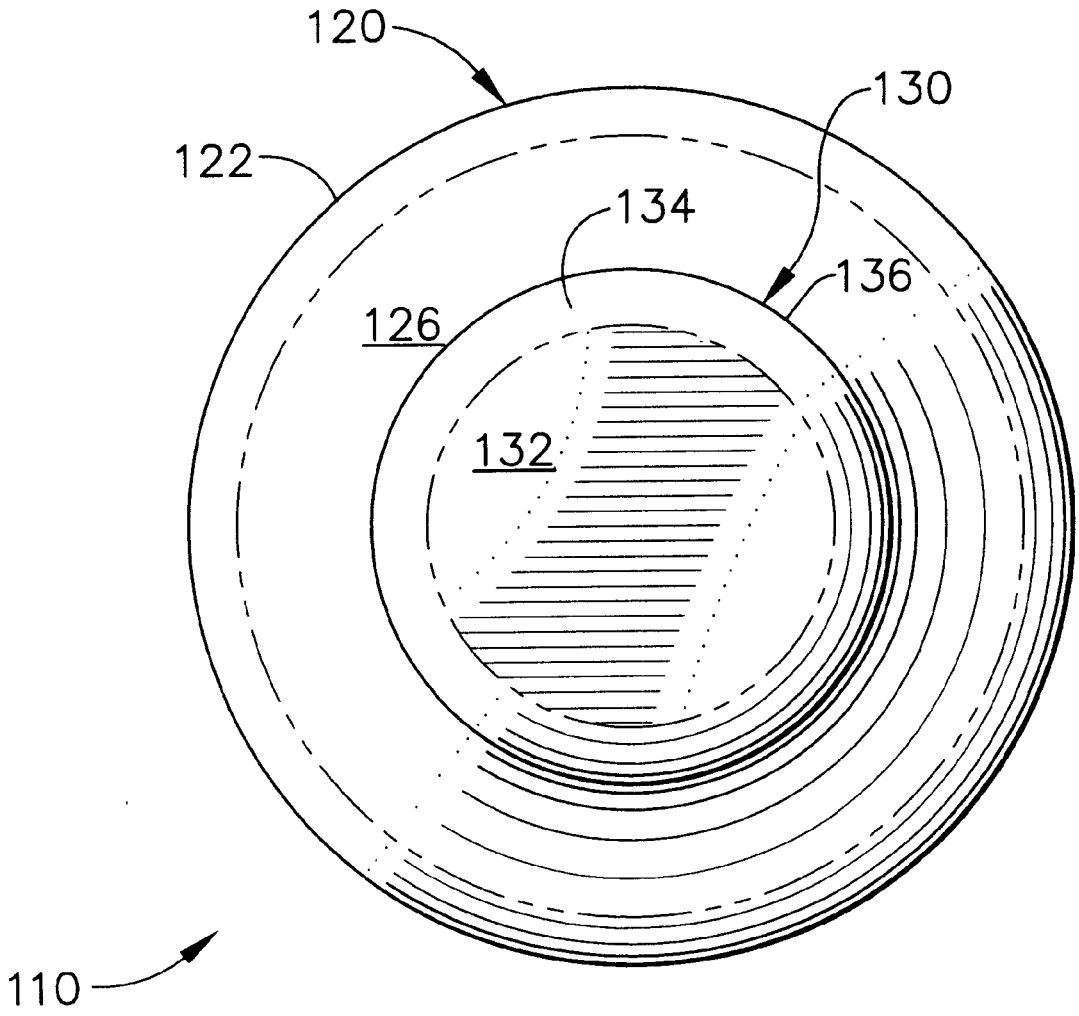
FIG. 16 is a bottom plan view of the garbage disposal plunger of FIG. 9.

FIG. 16 is a bottom planar view of the plunger device 110. FIG. 16 shows the rounded outer shape of the stopper portion 120 with its maximum outer diameter 122. FIG. 16 also shows the rounded outer shape of the cylindrical plunger portion 130 having a distal end surface 132 which is preferably planar, and which has its circular outer diameter (in this view) at 136.

Figure 17:
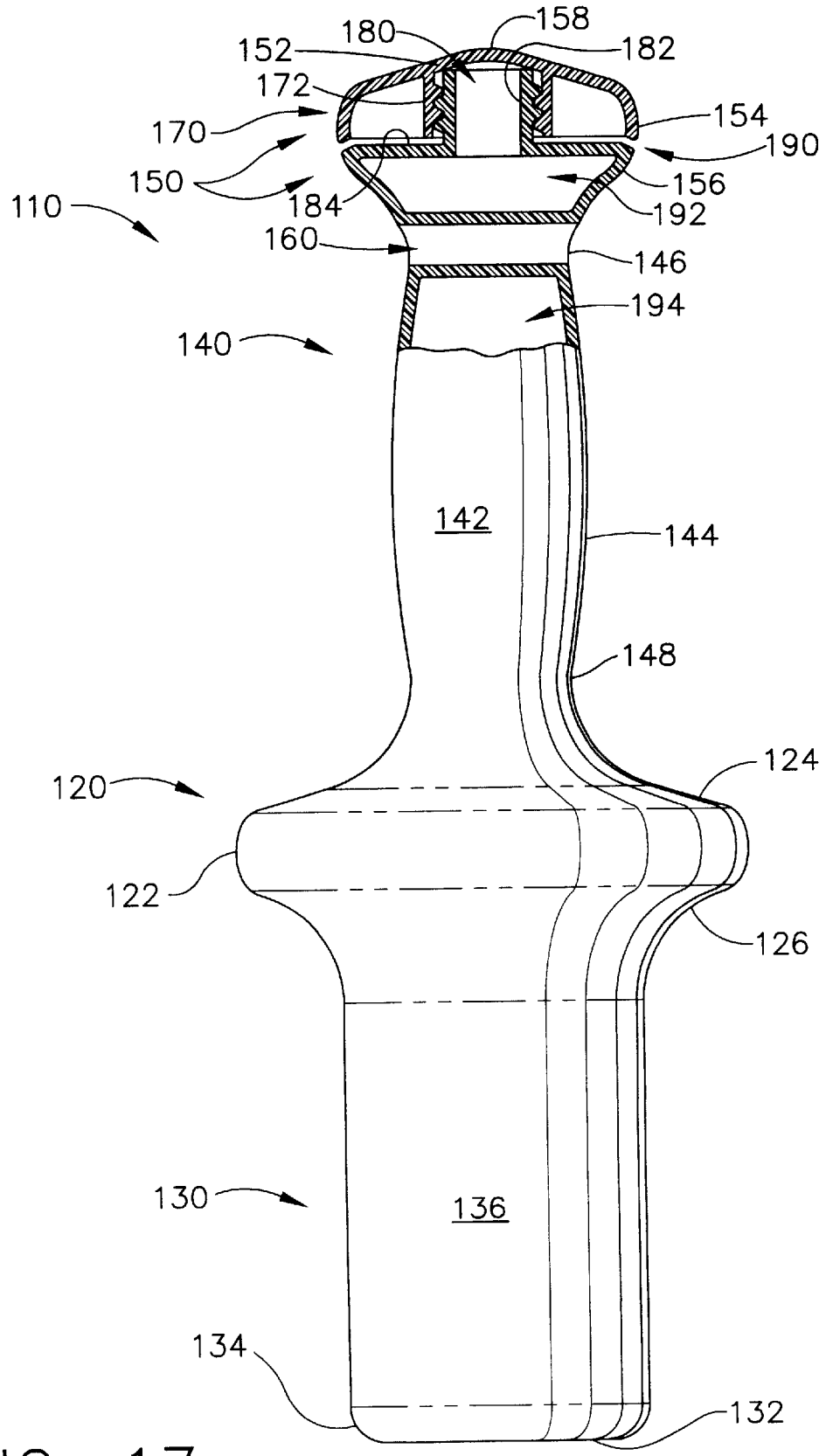
FIG. 17 is front elevational view in partial cross-section of the garbage disposal plunger of FIG. 9.

FIG. 17 shows some of the interior details of the knob portion 150, especially of the construction of the lid 170. The end surface 152, with its uppermost point at 158, and the maximum outer diameter 154 of the rounded contour surface make up the outer surface of the lid 170, while an interior threaded wall 172 comprises the member of lid 170 that mates to the remaining members of the plunger device 110.

The "bottom" member (as seen in FIG. 17) includes areas of the knob portions 150, including the rounded contour surface 156 and the top minimum outer diameter at 146, which make up the external surfaces of this area of the knob portion, as well as the through hole 160. The interior of the bottom member of knob portion 150 includes a threaded spout 180, and a planar upper surface at 184. The spout 180 essentially comprises a hollow cylinder that is threaded along the outer surface of its vertical (as seen in FIG. 17) wall 182. These external threads are designed to mate with the internal threads of the wall 172 of the lid 170. It is preferred that the threaded walls 172 and 182, when engaged, provide a largely liquid-tight seal, while at the same time it is preferred that the threaded engagement can be broken by a simple twisting motion of the lid by a human hand.

The interior volume or "chamber" of plunger device 110 will preferably include all interior spaces that are not needed to maintain structural integrity of the entire device, so that a maximum quantity of liquid can be placed therewithin. Some of the interior volume is visible on FIG. 17, including a space 192 that is nearest the lid gap 190 and above (as seen in FIG. 17) the through hole 160, and including a space 194 that is below (as seen in FIG. 17) the through hole 160.

By making the plunger device 110 into a liquid-containing "bottle," the present invention can thereby readily perform two functions: (1) that of holding and dispensing a liquid (such as a hand soap or a dish washing detergent) through the spout 180, and (2) acting as a garbage disposal plunger that is placed into the opening of a garbage disposal up to a predetermined distance, but is prevented from being inserted past that predetermined distance by the stopper member 22.

It will be understood that the precise construction of the plunger device 110 (or 10) can be modified to various degrees without departing from the principles of the present invention. For example, the threaded lid 170 could be eliminated by using a hinged lid structure, so that the lid would be "snapped" closed and "unsnapped" open by the human user. Certainly other forms of lid structures are envisioned by the inventors, including a lid that slides "up" to be in an "open" position, and then slides "down" to be in a "closed" position. Moreover, the lid could exhibit child-proof characteristics.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. An apparatus for pushing refuse into a garbage disposal unit, said apparatus comprising:

a plunger member which exhibits a first outer dimension that is sized to be inserted through an opening of a sink garbage disposal unit, said plunger member extending from a first end of said apparatus to a point between said first end and a second end of said apparatus, said plunger member exhibiting a solid, substantially non-flexible outer surface;

a stopper member that is sized to prevent its insertion through said opening of a sink garbage disposal unit, said stopper member being of a second outer dimension that is greater than said first outer dimension of said plunger member, said stopper member being positioned adjacent to said plunger member between said first and second ends of the apparatus, said stopper member being located within a middle one-third of said apparatus along a longitudinal axis between said first and second ends;

a handle member that extends from said stopper member toward said second end of said apparatus, said handle member exhibiting a third outer dimension that is less than said second outer dimension of said stopper member, said handle member exhibiting a solid, substantially non-flexible outer surface; and a knob member that is located at said second end of said apparatus, and is adjacent to said handle member, said knob member having a rounded outer contour shape that, in combination with said handle member, enhances a gripping capability of a human hand;

wherein said handle member exhibits a gradually curved, convex-shaped surface between said stopper member and said knob member.

2. The apparatus as recited in claim 1, wherein said knob member exhibits a fourth outer dimension that is greater than said third outer dimension of said handle member.

3. The apparatus as recited in claim 2, wherein said knob member's fourth outer dimension is less than said second outer dimension of said stopper member.

4. The apparatus as recited in claim 1, wherein said outer contour shape of the knob member exhibits a maximum cross-section near the second end of said apparatus, yet smoothly changes to minimum cross-section at the very distal portion of the second end of said apparatus, and further smoothly changes to a smaller cross-section at a location where it meets said handle member in their adjacent relationship; wherein said smaller cross-section provides a first surface area that is easily gripped by the fingers of a human hand, and wherein said maximum cross-section and smoothly changing minimum cross-section in combination provide a second surface area that mates well to the palm of a human hand.

5. The apparatus as recited in claim 4, wherein said knob member's appearance is due to a shape that decreases the likelihood of the human user's hand slipping from said knob member.

6. The apparatus as recited in claim 1, wherein the combined outer shape of said handle member and said knob member provides a smooth outer contour that allows increased gripability by a human hand while decreasing the likelihood of the human user's hand slipping tom said knob member.

7. The apparatus as recited in claim 1, wherein said stopper member exhibits rounded, smooth outer edges.

8. The apparatus as recited in claim 7, wherein the second outer dimension of said stopper member is of a shape and size to inhibit the placement of said human hand through said opening of a sink garbage disposal unit at a time that said apparatus is in use while said plunger member is inserted into said opening.

9. The apparatus as recited in claim 7, wherein said plunger member extends a predetermined distance from said stopper member to said first end of the apparatus, such that said predetermined distance is sufficiently short to prevent said firs tend of the apparatus from contacting a moving part of said sink garbage disposal unit.

10. The apparatus as recited in claim 1, further comprising a through-hole located proximal to said adjacent configuration between said knob member and said handle member.

11. The apparatus as recited in claim 1, wherein said knob member further comprises a removable lid that allows access to an interior chamber of said apparatus.

12. The apparatus as recited in claim 11, wherein said removable lid comprises a threaded interior wall, and wherein said knob member further comprises a threaded spout that effectively mates with said removable lid.

13. A garbage disposal plunger apparatus, comprising: an elongated structure having a longitudinal axis extending between two ends; a knob portion of said elongated structure disposed at a first of said two ends, wherein said knob portion is sized and shaped in a manner such that its end-most portion is rounded and substantially smooth, then increasing in width to a maximum size that is gripable by a palm and fingers of a human hand, then at a point further along said longitudinal axis decreasing in width to a size that is gripable by fingers of a human hand, wherein said changes in width are manifested by substantially smooth surface contours; a shank member of said elongated structure that extends further along said longitudinal axis from said knob portion to a stopper member of said elongated structure, said shank member having a substantially smooth outer contoured surface, said shank member exhibiting a solid, substantially non-flexible outer surface; said stopper member being larger in outer dimension than said shank member and sized to prevent its insertion through an opening of a sink garbage disposal unit; and a plunger member of said elongated structure that extends further along said longitudinal axis from said stopper member to a second of said two ends of the elongated structure, said plunger member exhibiting a solid, substantially non-flexible outer surface, said plunger member extending a sufficient distance from said stopper member such that said stopper member is located within a middle one-third of said apparatus along said longitudinal axis between said two ends, said plunger member being smaller in outer dimension than said stopper member, and said plunger member being sized for insertion through the opening of said sink garbage disposal unit;

wherein said shank member exhibits a gradually curved, convex-shaped surface between said stopper member and said knob member.

14. The garbage disposal plunger apparatus as recited in claim 13, wherein said plunger member exhibits a length dimension along said longitudinal axis that extends a predetermined distance from said stopper member to said second end of said elongated structure, such that said predetermined distance is sufficiently short to prevent said second end of the elongated structure from contacting a moving part of said sink garbage disposal unit.

15. The garbage disposal plunger apparatus as recited in claim 13, wherein said knob portion's appearance is due to a shape that decreases the likelihood of the human user's hand slipping from said knob member.

16. The garbage disposal plunger apparatus as recited in claim 13, wherein said stopper member exhibits rounded, smooth outer edges.

17. The garbage disposal plunger apparatus as recited in claim 13, wherein the outer dimension of said stopper member is of a shape and size to inhibit the placement of said human hand through said opening of a sink garbage disposal unit at a time that said garbage disposal plunger apparatus is in use while said plunger member is inserted into said opening.

18. The garbage disposal plunger apparatus as recited in claim 13, further comprising a through-hole located proximal to a conjunction between said shank member and said knob portion.

19. The garbage disposal plunger apparatus as recited in claim 13, wherein said knob member further comprises a removable lid that allows access to an interior chamber of said apparatus.

20. The garbage disposal plunger apparatus as recited in claim 19, wherein said removable lid comprises a threaded interior wall, and wherein said knob member further comprises a threaded spout that effectively mates with said removable lid.

21. A combination liquid-holding container and garbage disposal plunger apparatus, comprising:

a plunger member which exhibits a first outer dimension that is sized to be inserted through an opening of a sink garbage disposal unit, said plunger member extending from a first end of said apparatus to a point between said first end and a second end of said apparatus, said plunger member exhibiting a solid, substantially non-flexible outer surface;

a stopper member that is sized to prevent its insertion through said opening of a sink garbage disposal unit, said stopper member being of a second outer dimension that is greater than said first outer dimension of said plunger member, said stopper member being positioned adjacent to said plunger member between said first and second ends of the apparatus, said stopper member being located within a middle one-third of said apparatus along a longitudinal axis between said first and second ends;

a handle member that extends from said stopper member toward said second end of said apparatus, said handle member exhibiting a third outer dimension that is less than said second outer dimension of said stopper member, said handle member exhibiting a solid, substantially non-flexible outer surface; and a knob member that is located at said second end of said apparatus, and is adjacent to said handle member, said knob member having are removable lid that allows access to an interior chamber of said apparatus;

wherein said handle member exhibits a gradually curved, convex-shaped surface between said stopper member and said knob member.

22. The combination liquid-holding container and garbage disposal plunger apparatus as recited in claim 21, wherein said removable lid comprises a threaded interior wall, and wherein said knob member further comprises a threaded spout that effectively mates with said removable lid.

23. The combination liquid-holding container and garbage disposal plunger apparatus as recited in claim 21, wherein said interior chamber contains a liquid.

24. The combination liquid-holding container and garbage disposal plunger apparatus as recited in claim 23, wherein said liquid comprises one of: dishwasher detergent, hand soap, or sink cleanser.

* * * * *

UNITED STATES PATENT AND TRADEMARK OFFICE

CERTIFICATE OF CORRECTION

PATENT NO. : 6,718,852 B1
DATED : April 13, 2004
INVENTOR(S) : Harry Mordt Bickel It is certified that error appears in the above-identified patent and that said Letters Patent is hereby corrected as shown below:

Column 10,
Line 4, delete “to minimum” and insert therefor -- to a minimum --.
Line 23, delete “tom” and insert therefor -- from --.
Line 36, delete “firs tend” and insert therefor -- first end --.

Signed and Sealed this

First Day of June, 2004

JON W. DUDAS
*Acting Director of the United States Patent and Trademark Office*